United States Patent [19]

Oeckl

[11] 4,078,594

[45] Mar. 14, 1978

[54] CONTAINER FOR GOLF CLUBS

[76] Inventor: Otto Oeckl, Tizianstrasse 60, 8000 Munich 19, Germany

[21] Appl. No.: 764,189

[22] Filed: Jan. 31, 1977

[30] Foreign Application Priority Data

| | | |
|---|---|---|
| Feb. 3, 1976 | Germany | 2603944 |
| Oct. 27, 1976 | Germany | 2648587 |

[51] Int. Cl.[2] ..... A63B 55/00

[52] U.S. Cl. ..... 150/1.5 B; 280/47.26; 280/DIG. 6; 297/188

[58] Field of Search ..... 150/1.5 R, 1.5 B, 1.5 C; 280/DIG. 6, 47.26, 652; 220/8; 297/188

[56] References Cited

U.S. PATENT DOCUMENTS

| | | | |
|---|---|---|---|
| 1,252,775 | 1/1918 | Butcher | 220/8 |
| 1,414,875 | 5/1922 | Hanaford | 150/1.5 R |
| 2,031,119 | 2/1936 | Moreland | 150/1.5 R X |
| 2,422,315 | 6/1947 | Robinson | 150/1.5 B |
| 2,837,346 | 6/1958 | Chambless | 150/1.5 B X |
| 2,919,017 | 12/1959 | Weber | 220/8 X |
| 3,985,373 | 10/1976 | Widegren | 150/1.5 B X |

*Primary Examiner*—Donald F. Norton

*Attorney, Agent, or Firm*—Scully, Scott, Murphy & Presser

[57] ABSTRACT

A container for golf clubs comprises a pair of axially aligned tubular body portions each having a respective outer end through which the golf clubs may be inserted for storage and retrieved for use. One body portion has an end portion which is engaged slidably within the other body portion for axial sliding movement of that body portion relative to the other body portion. When one body portion is projected outwardly relative to the other body portion until a respective one of a first pair of abutment surfaces engages with the other abutment surface of that pair of abutment surfaces, the golf clubs which are stored in the body portions are enclosed over their full length so that the container is in condition for transportation to and from the golf course. The container is converted into the condition for use on the golf course by sliding one body portion inwardly relative to the other body portion until a respective one of a second pair of abutment surfaces engages with the other abutment surface of that pair of abutment surfaces so that the golf clubs project from the outer end of the other body portion.

13 Claims, 9 Drawing Figures

FIG. 3
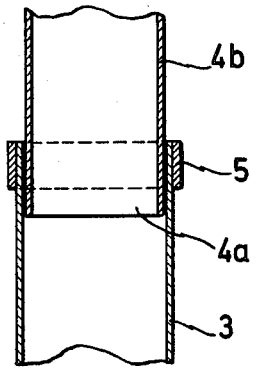
FIG. 4
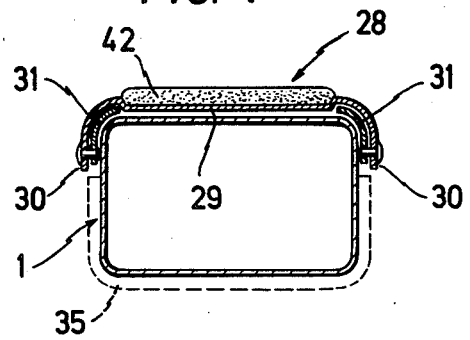
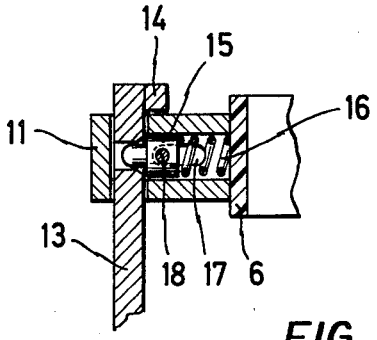
FIG. 5
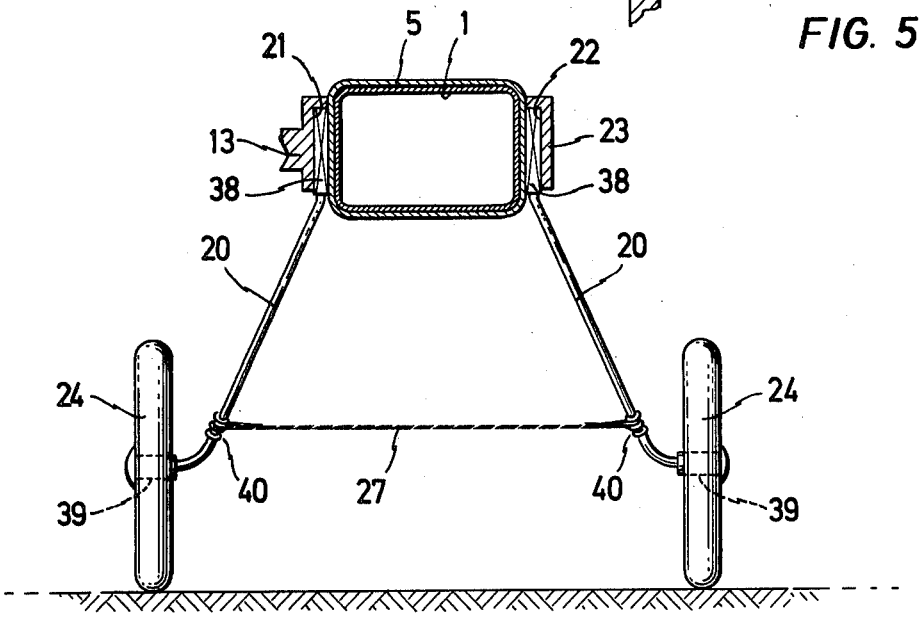
FIG. 7

CONTAINER FOR GOLF CLUBS

This invention relates to containers for golf clubs.

Usually a container for golf clubs comprises a bag which is made of a pliable material. The bag is designed so that the shafts of the clubs can be accommodated in the bag while the heads of the clubs project from the top of the bag. The bag includes a flexible hood which is fitted to the body of the bag so as to cover the heads for transporting the bags to and from the golf course. The bag may be transported in the boot of a car or in the luggage compartment of an aircraft when the golf player is travelling by air. When additional luggage is stored in the same compartment in which the bag is transported, there is a danger for the golf clubs to be damaged if the additional luggage is placed or thrown an top of the bag.

Most of the known golf bags are unwieldy and bulky which is undesirable for the transport of the bags.

It is an object of this invention to provide an improved container for golf clubs which protects the golf clubs sufficiently from damage during the transportion of the container and which can be made less bulky than the known bags but is capable of carrying at least the same member of golf clubs as the known bags.

Figure 1:
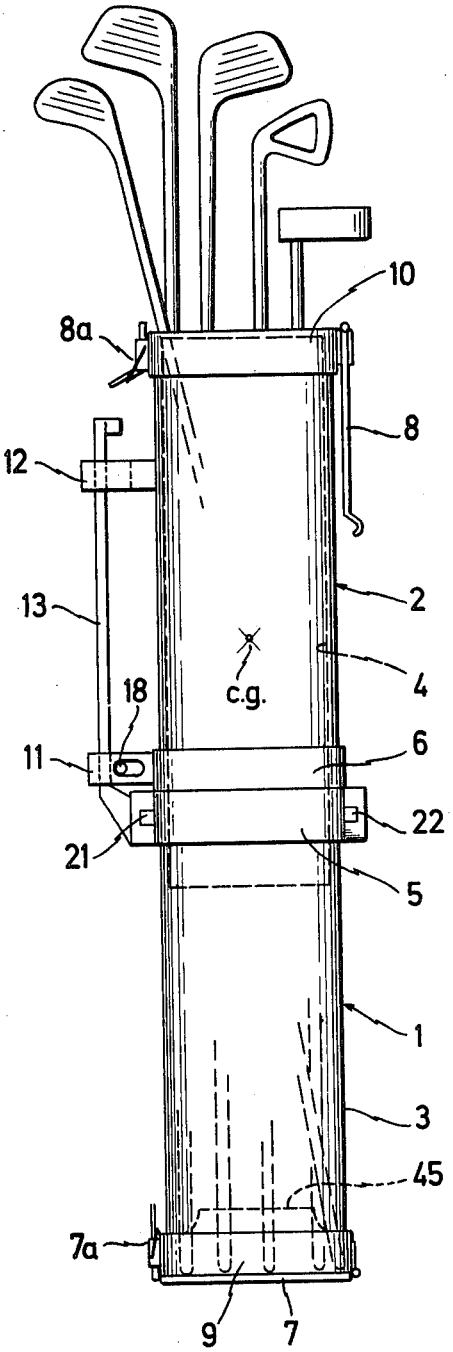
Figure 2:
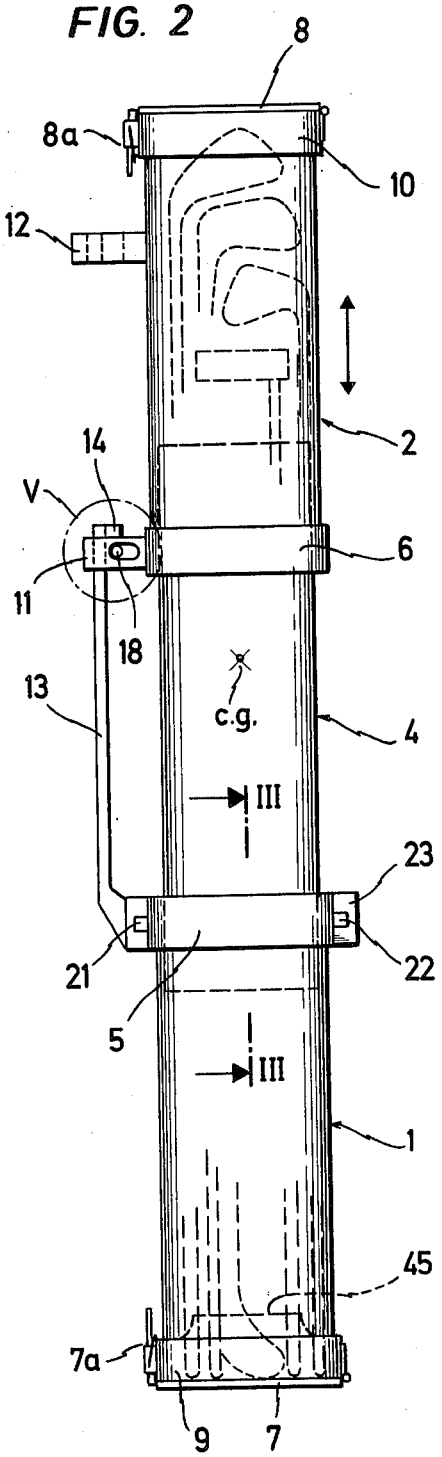
Figure 6:
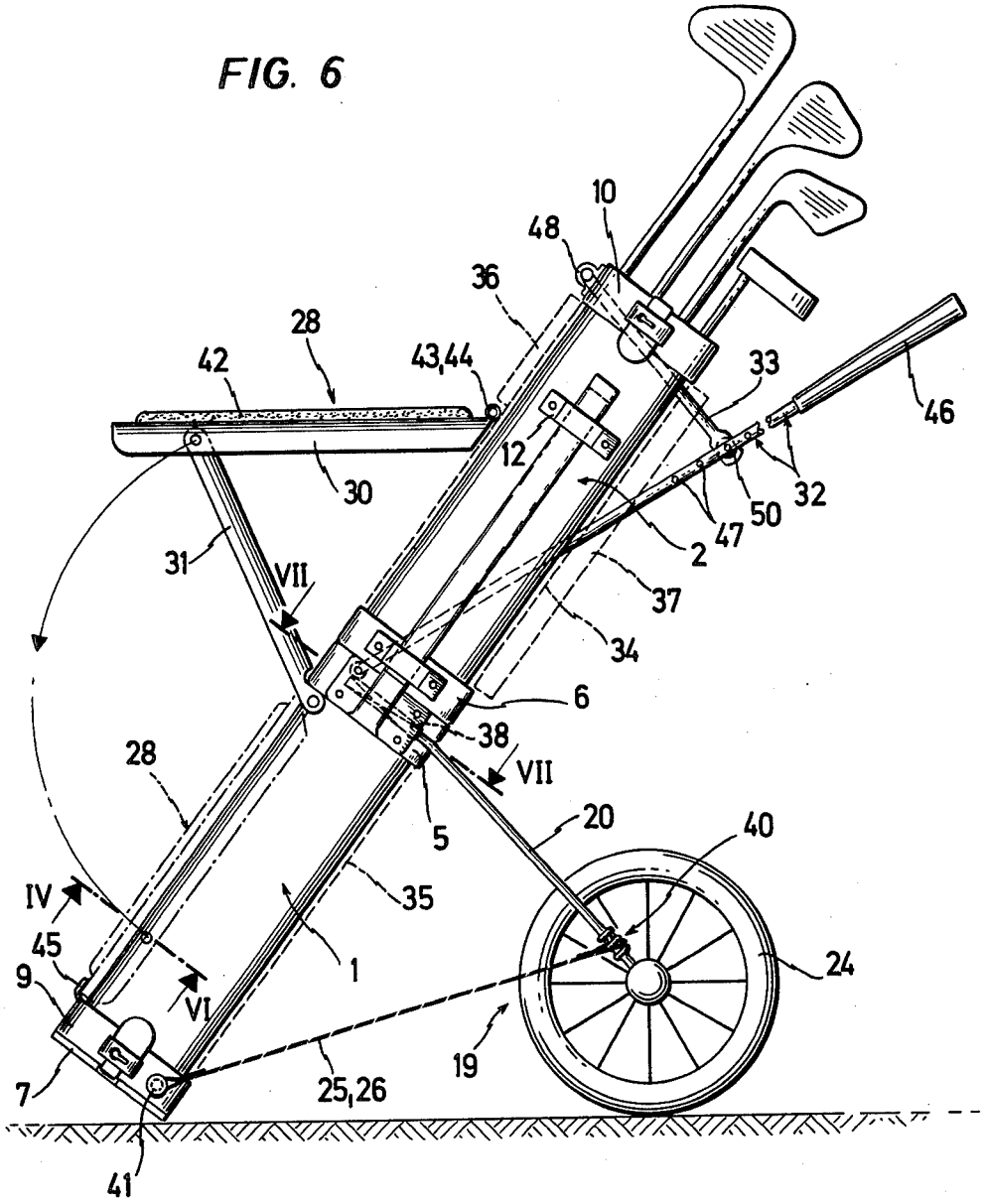
Figure 8:
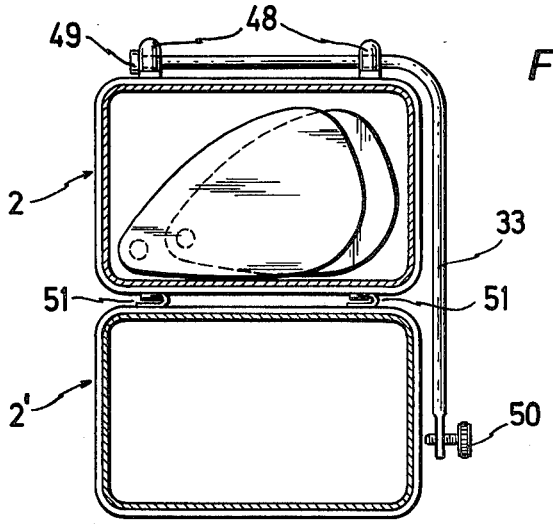

An embodiment of this invention will be described now by way of example and with reference to the accompanying drawings, in which FIG. 1 is a side view of a container for golf clubs, the container being illustrated in a first condition in which the golf clubs project from an outer end of the container, FIG. 2 is a view similar to the one shown in FIG. 1 and illustrates the container in a second condition in which the golf clubs are enclosed over their full length, FIG. 3 is a fragmentary sectional view of the container taken along Line III—III in FIG. 2 illustrating a sleeve and a tubular shaft having an end portion which is inserted in that sleeve, FIG. 4 is an enlarged sectional view of the container the section being taken along the line VI-IV of FIG. 6, FIG. 5 is an enlarged sectional view of the detail V which is encircled in FIG. 2, FIG. 6 illustrates the container in the first condition, including a drawbar, an undercarriage and a flap seat which is shown in its position for use, FIG. 7 is a fragmentary end view of the container shown in FIG. 6, FIG. 8 is a cross-sectional view of a modified version of the container shown in FIGS. 1 to 7

Figure 9:
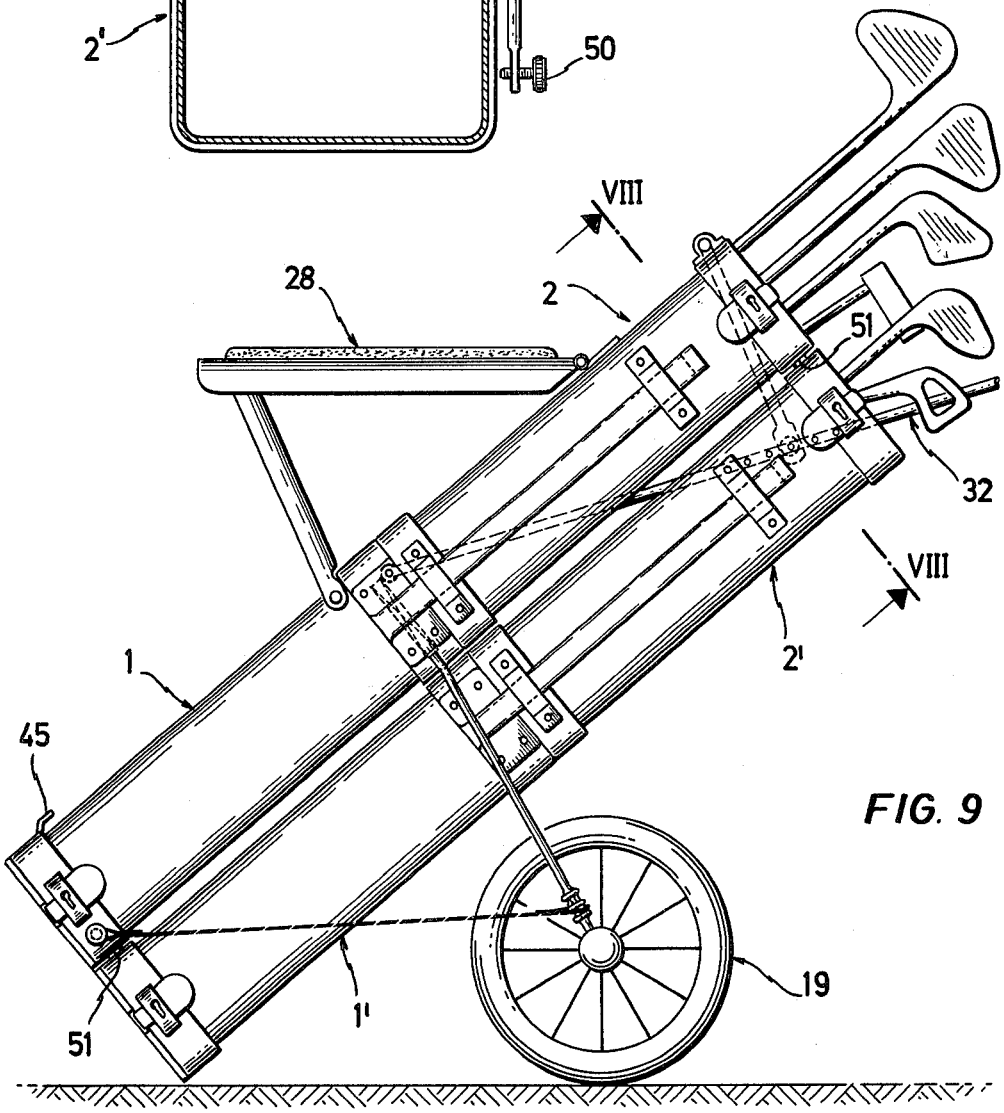

FIG. 9 illustrates the modified container in condition for use on the "links".

Referring to FIGS. 1 to 7 of the drawings, a container for golf clubs comprises a pair of axially aligned tubular body portions 1 and 2, each being substantially rectangular in cross-section. The golf clubs are stored axially in the body portions 1 and 2, each of which has a respective outer end through which the golf clubs are inserted into the body portions 1 and 2 and retrieved from the body portions 1 and 2. The body portion 1 comprises a tubular sleeve 3 and a tubular shaft 4. The tubular sleeve 3 has an internal cross-sectional area which is equal to the external cross-sectional area of the tubular shaft 4 and to the internal cross-sectional area of the body portion 2. The tubular shaft has a first portion **4*a* which is inserted in the tubular sleeve 3 and bonded to the sleeve 3 so that the shaft 4 is held in position relative to the sleeve 3 and a second portion 4*b* which projects from the sleeve 3. The second portion 4*b* of the shaft 4 is engaged slidably in the tubular body portion 2 for axial sliding movement of the tubular body portion 2. The tubular body portion 1 is slidable axially outwardly from a first position in which the whole second portion 4*b* of the shaft 4 is located within the body portion 2 into a second position in which an end section of the second portion 4*b* is located in the body portion 2 and an intermediate section of the second portion 4*b*, which extends between the end section and the first portion 4*a* which is received in the sleeve 3**, is exposed.

A first annular member 5 is mounted co-axially on the tubular sleeve 3 at that end thereof from which the second portion **4*b* of the shaft 4 projects. A second annular member 6 is mounted co-axially on the body portion 2 at that end thereof which faces the tubular sleeve 3. Each of the first and second annular members 5 and 6 has a respective one of a first pair of abutment surfaces which co-act with one another to limit inward movement of the tubular body portion 1 relative to the tubular body portion 2**.

A pair of lids 7 and 8 is provided for closing the body portions 1 and 2 at their outer ends respectively. The lid 7 is hinged to a third annular member 9 which is mounted co-axially on the tubular sleeve 3 at the outer end of the body portion 1. The lid 8 is hinged to a fourth annular member 10 which is mounted co-axially on the tubular body portion 2 at its outer end. Each lid 7, 8 is pivotable from a position in which it extends across the respective one of the outer ends of the body portions 1 and 2 so as to close that outer end into a position in which it extends parallel to the axes of the body portions 1 and 2 so that the respective one of the outer ends is open.

Each lid 7, 8 may be held in closed position by the engagement of that lid and a respective one of a pair of locks respectively, **7*a* and 8*a*. The locks 7*a* and 8*a* are mounted respectively on the annular members 9 and 10**.

A first lug 11 is mounted on the second annular member 6 and projects from the second annular member 6 at right angles to the axis of the tubular body portion 2. The first lug 11 has a wall portion which defines an aperture, the axis of which extends parallel to the axis of the body portion 2. A second lug 12 is mounted on the body portion 2 at a point thereon which is between the first lug 11 and the outer end of the body portion 2. The second lug 12 projects from the body portion 2 at right angles to the axis of the body portion 2 and has a wall portion which defines an aperture, the axis of which is parallel to the axis of the body portion 2. The apertures of the first and second lugs 11 and 12 are aligned axially with one another. A bar 13 has a first portion which extends parallel to the axes of the body portions 1 and 2, a second portion which extends at an angle to the axis of the first portion of the bar 13 and a root portion by which the bar 13 is mounted to the first annular member 5 which is mounted on the tubular body portion 1 so that the bar 13 is movable axially with the tubular body portion 1. The first portion of the bar 13 is nearer to the outer end of the tubular body portion 2 than is the second portion of the bar 13. The first portion of the bar 13 is spaced from a respective one of the body portions 1 and 2 by a distance which is sufficient for a person to clasp the first portion with his hand so that he can use the bar 13 as a handle by which the container may be carried. The first portion of the bar 13 projects through the aperture that is defined in the first lug 11 and is engaged slidably with the wall portion defining the aperture of the first lug 11. The first portion of the bar 13 carries an abutment member 14 which is mounted on the first portion at its end which is remote from the second portion of the bar 13. Each of the abutment member 14 and the first lug 11 has a respective one of a second pair of abutment surfaces which co-act with one another to limit outward movement of the tubular body portion 1 relative to the tubular body portion 2.

The first portion of the bar 13 projects through the aperture of the second lug 12 when the tubular body portion 1 is in its first position, and is spaced axially from the second lug 12 when the tubular body portion 1 is in its second position. The aperture of the second lug 12 is sufficiently large for it to provide clearance for the annular member 14 which is carried by the first portion of the bar 13 so that the annular member 14 can pass through the aperture of the second lug 12 when the body portion 1 is reciprocated between its first and second positions.

The first lug 11 has a further wall portion which defines a cylindrical cavity within the lug 11 and a mouth of the cavity.

The axis of the cylindrical cavity extends transversely to the axis of the aperture that is formed in the first lug 11. The mouth of the cavity is defined in the periphery of the aperture that is formed in the first lug 11. The cavity is closed at its end remote from the mouth by the wall of the annular member 6. A plunger 15 is slidable axially in the cavity defined in the first lug 11. The plunger has an integral finger which projects from that end of the plunger 15 which is remote from the annular member 6. A coil spring 16 is located in the space defined between the plunger 17 and the wall of the annular member 6 and acts on that end of the plunger 15 which is remote from the finger of plunger 15 and takes its reaction from the wall of the annular member 6 so as to urge the plunger 15 towards the mouth of the cavity.

The first lug 11 has a pair of elongate apertures 17 which are defined in the wall defining the cylindrical cavity. The apertures 17 face each other and extend parallel to the axis of the cylindrical cavity. The plunger 15 has a transverse through bore in which a pin 18 is located. The pin 18 has a pair of end portions each projecting from a respective one of the two ends of the through bore that is defined in the plunger 15. Each end portion of the pin 18 projects through a respective one of the apertures 17 that are defined in the first lug 11.

Each end portion of the pin 18 is held in abutment with a peripheral portion of the wall defining a respective of the apertures 17 by the action of the spring 16 upon the plunger 15 so that the plunger 15 is retained within the cavity defined in the first lug 11, the peripheral wall portion being defined at that end of the respective aperture 17 which is remote from the annular member 6. The finger, which is defined on the plunger 15 projects from the mouth of the cavity and is engaged with a wall portion defining a respective one of a pair of bores which are defined in the first portion of the bar 13 so that the body portion 1 is retained against axial movement relative to the body portion 2.

The bores that are defined in the first portion of the bar 13 are spaced from one another by a distance which is equal to the length of the path of axial sliding movement of the body portion 1 relative to the body portion 2 and are positioned relative to the body portion 1 so that when the body portion 1 is in its first position the finger defined on the plunger 15 projects into that bore which is nearer to the second portion of the bar 13 and when the body portion 1 is in its second position the finger of the plunger 15 projects into the other bore which is adjacent to the abutment member 14 that is carried by the first portion of the bar 13.

To retract the finger projecting from the plunger 15 from the respective one of the bores that are defined in the first portion of the bar 13, the plunger 15 is urged towards the annular member 6 against the action of the spring 16 by urging the end portions of the pin which project from the apertures 17 towards the annular member 6.

The length of each body portion 1, 2 and the length of the axial path of sliding movement of the body portion 1 relative to the body portion 1 is in its second position the golf clubs that are stored in the container are enclosed by the body portion 1 and 2 over their full length and when the body portion 1 is in its first position the golf clubs project from the outer end of a respective one of the body portion 1 and 2.

FIG. 1 illustrates the container in a first condition in which the container is suitable for use on the links. As can be seen from FIG. 1 the first and second annular members 5 and 6 are in abutment with one another so as to restrain the body portion 1 from further inward movement relative to the body portion 2. The finger projecting from the plunger 15 is engaged with the wall portion defining that bore which is adjacent to the second portion of the bar 13 so that the body portion is retained against axial movement in opposite directions. Thus the body portion 1 is held in its first position by the abutment of the first and second annular members 5 and 6 and the engagement of the finger projecting from the plunger 15 and the wall of the respective one of the bores that are defined in the first portion of the bar 13. The outer end of the body portion 1 is closed by the lid 7 which is held in locked position by the engagement of that lid 7 and the lock **7*a*, and the outer end of the body portion 2 is open. The heads of the golf clubs project from the outer end of the body portion 2 and the shafts of the golf clubs rest against the lid 7. The golf clubs are retrieved from the container through the outer end of the body portion 2**.

FIG. 2 illustrates the container in a second condition in which the container is suitable for transportion to and from the golf course. The abutment member 14 is in abutment with the second lug 11 so as to restrain further outward movement of the body portion 1 relative to the body portion 2. The finger projecting from the plunger 15 is engaged with the wall defining the other bore that is defined in the first portion of the bar 13 so as to retain the body portion 1 against axial movement in opposite directions relative to the body portion 2. Thus, the body portion 1 is held in its second position by the engagement of the abutment member 14 and the first lug 11 and by the engagement of the finger projecting from the plunger 15 and the wall of the respective bore that is defined in the first portion of the bar 13. The golf clubs are enclosed over their full length by the body portions 1 and 2. Each outer end of the respective one of the body portion 1 and 2 is closed by a respective one of the lids 7 and 8 which are held in locked condition by their engagement with the respective one of the locks **7*a* and 8*a***.

To convert the container from one condition into the other condition, the end portions of the pin 18 which project from the apertures 17 are urged towards the annular member 6 against the action of the spring 16 upon the plunger 15 so that the finger projecting from the plunger 15 is retracted from the respective one of the bores that are defined in the first portion of the bar 13.

Then the body portion 1 is moved axially relative to the body portion 2 in the prescribed direction by applying an axial thrust to the body portion 1. It is to be understood that the lid 8 is disengaged from the lock 8*a* and pivoted into the open position before the body portion 1 is moved axially inwardly relative to the body portion 2 so as to enable the heads of the clubs to project from the outer end of the body portion 2.

The length of the bar 13 and the position of the bar 13 relative to the body portions 1 and 2 are selected so that the center of gravity c.g. is bridged by the bar 13 irrespective of whether the container is in the first condition or in the second condition. The container is balanced in the first condition and in the second condition when the container is carried by the bar or handle 13.

The container comprises a detachable undercarriage 19 which includes a pair of struts or legs 20 which are splayed apart so that they are substantially of inverted V-formation. The struts are made of spring steel. Each strut 20 has a respective end portion 38 which is rectangular in section and which extends at an angle to the axis of that strut 20. Each end portion 38 of the respective strut 20 is inserted in a respective one of a pair of holes 21 and 22, each having a cross-sectional area which matches the profile of each end portion 38 of the respective strut 20. The hole 21 is defined by a U-shaped recess which is formed in the root portion of the bar 13 and by a peripheral wall portion of the first annular member 5 and is closed at one end by a wall portion of the root portion of the bar 13. The hole 22 is defined by a another peripheral wall portion of the first annular member 5 and a U-shaped recess which is defined in a bracket 23 which is secured to the first annular member 5 at that side thereof which is remote from the bar 13, and is closed at one end by a wall portion of the bracket 23. The axes of the holes 21 and 22 are parallel and extend transversely to the axes of the body portions 1 and 2. Each strut 20 has another end portion 39 which is remote from that end portion 38 which is inserted in the respective one of the holes 21, 22 extends at an angle to the axis of that strut 20 and serves as an axle for a respective one of a pair of wheels 24 which are secured detachably to the other end portions 39 of the struts 20 for rotation relative to the struts 20.

The struts 20 are orientated so that they extend downwardly towards the ground at an angle to the axes of the body portions 1 and 2. The other end portions 39 carrying the wheels 24 extend outwardly in opposite directions. Each strut 20 has a respective set of three annular projections 40 which are spaced apart so as to define a pair of annular grooves between then. The struts 20 are held in position by a set of three wires 25, 26 and 27, the wires 25 and 27 being illustrated in FIG. 6 and in FIG. 7 respectively, the wire 26 being not visible in FIG. 6.

Each wire 25, 26, 27 has a pair of loops, each being defined at a respective end of that wire. The wire 27 extends between the struts 20 and is connected to each strut 20 by the engagement of each loop of the wire 27 and a respective one of the annular grooves that are defined between the respective annular projections 40. Each wire 25, 26 extends between a respective one of the struts 20 and the annular member 9 which has a pair of projections 41 defined at opposite sides of the annular member 9. Each projection 41 has a thickened head portion and a stem portion which has a smaller diameter than the respective head portion so as to define an annular groove between the head portion and the peripheral wall of the annular member 9. Each wire 25, 26 is connected detachably at one end to a respective one of the struts 20 by the engagement of its loop defined at that end and the other annular groove defined between the respective projections 40, and is connected detachably at its other end to the annular member 9 by the engagement of its loop defined at that end and the annular groove that is defined by the respective projection 41. The wires 25, 26 and 27 are stretched. Each profiled end portion 38 of the respective strut 20 is held in frictional engagement with the wall defining the respective one of the holes 21 and 22 by the pre-load that is applied to the struts 20 so that each end portion of the respective strut is located axially and radially within the respective one of the holes 21 and 22 and rattling of the end portions 38 within the holes 21 and 22 is avoided. Each outer end of the respective end portion 38 abuts the respective wall portion which closes the respective one of the holes 21 and 22 so that the struts 20 are prevented from slipping through the holes 21 and 22 when an excessive loading is applied to the undercarriage 19.

To detach the undercarriage 19 from the body portions 1 and 2, each wire 25, 26 is detached from the respective one of the projections 41 that are defined on the third annular member 9. Then the profiled end portions 38 of the struts 20 which are located in the holes 21 and 22 are withdrawn from the holes 21 and 22. Finally, the wheels 24 are detached from the struts 20. FIG. 6 illustrates the container including the undercarriage 19 in the position for use on the golf course. As will be seen from FIG. 6, the weels 24 and the outer end of the body portion 1 bear against the ground so as to support the container when stationary. The undercarriage is detached from the body portion 1 and 2 for transporting the container to and from the golf course.

The container has a flap seat 28 which is arranged at that side of the container which is remote from the undercarriage 19 and which comprises a rectangular plate 29 which has a pair of lateral end portions 30 which are turned downwardly relative to the plane of the plate 29. The rectangular plate 29 is connected pivotally by a pair of struts 3 to the body portion. Each strut 31, which is angular in section, is connected pivotally at one of its ends to a respective one of the lateral end portions 30 of the rectangular plate 29 at a point thereon which is adjacent to an outer end of the plate 29, and is connected pivotally at its other end to the body portion 1 by a respective pin which projects through the wall of the tubular sleeve 3 and the end portion 4*a* of the tubular shaft 4. Each strut 31 is disposed at that side of the respective one of the lateral end portions 30 which faces the other lateral end portion 30. The pivot axes of the struts 31 and the rectangular plate 29 are parallel and extend transversely to the axes of the body portions 1 and 2. The flap seat 28 is padded by a rectangular cushion 42 which is bonded to the rectangular plate 29. FIG. 6 illustrates the flap seat 28 in the folded condition and in the condition for use, the flap seat 28 being shown in dotted lines in the folded condition and in full lines in the condition for use. FIG. 4 is a section through the container showing the flap seat 28 in the folded condition.

When the flap seat 28 is in the condition for use as shown in FIG. 6 the struts 31 project upwardly from the body portions 1 and 2 and extend at an angle to the plane of the plate 29. The inner end of the rectangular plate 29 bears against the body portion 2.

When the flap seat is in the folded condition, the rectangular plate 29 is seated upon the struts 31 as shown in FIG. 4. The flap seat extends between the first and third annular members 5 and 9 and is located in an annular recess which is defined by the first and third annular members and the outer surface of the body portion 1 so that the outer surface of the plate 29 does not raise above the radially outer periphery of the first and third annular members 5 and 9.

To convert the flap seat from the folded condition into the condition for use, the rectangular plate 29 is pivoted outwardly and the struts are pivoted upwardly. When the container is stationary and the outer end of the body portion 1 bears against the ground, the rectangular plate 29 extends parallel to the surface of the ground when the flap seat 28 is in the condition for use. The inner end of the plate 29 bears against the body portion 2 and the struts 31 supporting the rectangular plate 28 extend transversely to the axes of the body portions 1 and 2. When a person sits on the flap seat, a pull is exerted upon the wires 25, 26 and 27 by the weight loading that is induced into the container.

The rectangular plate 29 has a first array of integral lugs 43, which project from the inner end of the rectangular plate 29. The lugs 43 are spaced apart and each lug 43 has a respective aperture defined therein. The apertures are aligned axially relative to one another. A second array of lugs 44 are defined on the body portion 2 and each lug 44 has a respective aperture defined therein, the apertures being aligned axially relative to one another. The lugs 43 projecting from the inner end of the rectangular plate 29 and the lugs 44 that are defined on the body portion 2 interengage one another when the flap seat is in the condition for use.

The apertures which are defined in the first and second arrays of lugs 43 and 44 are in axial alignment with one another and a pin, which is not shown, is passed through the apertures so that the flap seat is held in its condition for use by the engagement of the pin and the lugs of the first and second arrays of lugs 43 and 44. Before the flap seat 28 is converted into the folded condition the pin is withdrawn from the apertures so as to enable the flap seat to be folded.

A third array of lugs, which are not shown, is defined on the first annular member 5. The lugs are spaced from one another and each lug has a respective aperture defined therein. When the flap seat is in the folded condition the first array of lugs 43 interengage with the third array of lugs and the apertures defined in the first and third arrays of lugs are in axial alignment. The same pin which has been used for retaining the flap seat in its condition for use is passed thorugh the apertures of the first and third arrays of apertures of the first and third arrays of apertures so that the flap seat 28 is held in its folded condition.

The annular member 9 has an integral nose 45 which projects from a peripheral edge of that annular member 9. The nose 45 is spaced from the surface of the tubular sleeve 3 so as to define a space between the surface of the nose the surface of the tubular sleeve. When the flap seat is in the folded condition the outer end of the rectangular plate 29 is inserted in the space defined between the nose 45 and the surface of the tubular sleeve 3 so that the outer end of the rectangular plate 29 is retained against outward movement relative to the tubular sleeve 3.

The container has a drawbar 32 which is connected pivotally and detachably at one of its ends to the annular member 5 at that side thereof which is opposite to the bar 13 and which has a handle 46. When the container is stationary, the drawbar extends upwardly at an angle to the surface of the ground. The drawbar 32 has a plurality of axially spaced tapped holes 47 formed in that portion of the drawbar 42 which extends between the handle 46 and the end of the drawbar 32 at which the drawbar is connected to the annular member 5. The holes 47 are nearer to the handle 46 to the end of the drawbar 32 at which the drawbar is than connected to the annular member 5. An angle member 33 is connected pivotally by a pair of lugs 48 to the annular member 10. Each lug 48 is fixed to the annular member 10 and has a respective aperture through which one arm of the angle member 33 projects. The angle member 33 carries an annular flange which is formed at an end of the arm which projects the lugs 48. The flange 49 abuts a peripheral surface portion of that lug which is remote from the other arm of the angle member 33 so that the angle member 33 is retained against axial movement to the lugs 48.

A hole is defined in the other arm of the angle member 33, at that end thereof which is remote from the arm by which the angle member 33 is connected to the annular member 10. The drawbar 32 is connected to the angle member 33 by a screw 50 which projects through the hole which is defined in the other arm of the angle member 38 and is inserted in a selected one of the tapped holes 47 that are defined in the drawbar 32 so that the drawbar 32 is located angularly relative to the plane of the ground.

The angular setting the drawbar 32 relative to the plane of the ground depends on the respective hole which has been selected for engagement with the screw 50. The angular setting of the drawbar 32 may be selected according to the size of the golf player using the container.

The body portion 2 is padded by an annular leather sheath 34 which is located in the annular recess which is defined by the second and fourth annular members 6 and 10 and the radially outer periphery of the body portion 2. The sheath 34 has an aperture through which the second lug 12 projects and a pair of integral flaps which are not shown, each flap a respective outer end which is connected detachably to the sheath 34 by a plurality of press-studs which are not shown.

The tubular sleeve 3 is padded by a leather sheath 35 which is located in the annular recess which is defined between the first and third annular members 5 and 9. The leather sheath 35 has a cut-away portion to provide clearance for the flap seat 28 when the flap seat is in the folded condition. The leather sheath 34 enclosing the body portion 2 is dotted in FIG. 6. The leather sheath 35 enclosing the tubular sleeve 3 is shown in dotted lines in FIG. 4 and FIG. 6.

The container includes a pair of bags 36 and 37 for golf balls, shoes, an umbrella and other accessories. The bags 36 and 37 are made of a thin pliable material which is water resistant. The bags 36 and 37 are sewed onto the leather sheath 34 at opposite sides thereof. Each bag 36, 37 is foldable and may be disposed between a respective one of the flaps which are defined on the sheath 34, and the sheath 34, when folded. The bags 36 and 37 are shown in dotted lines in FIG. 6.

The body portions 1 and 2 are made of glass fiber reinforced plastic in a conventional manner. A metal core which has a smooth radially outer surface is used for the manufacture of the body portion 2 so that a smooth radially inner surface of the body portion 2 is obtained. The tubular shaft 3 is made by laying the resin impregnated glass fiber material in the inside of a metal tube which has a smooth radially inner surface so that a smooth radially outer surface of the shaft 3 is obtained. The smoothness of the radially outer surface of the shaft 3 and the radially inner surface of the body portion 2 ensures that the body portion 1 is slidable axially relative to the body portion 2 by the golf player with very little effort. The glass fiber reinforced plastic body portions 1 and 2 are extremely light and very strong.

It will have become apparent that the first annular member 5 is connected to the bar 13, the undercarriage 19 and the drawbar 32 so that the forces which may be induced into the container through the bar 13, the undercarriage 19 and the drawbar 32 will be transmitted to the body portion 1 by the first annular member 5. The first annular member 5 is mounted co-axially on a portion of the body portion 1 which has a wall which is twice as thick as the wall of the remainder of the body portion 1. The struts 31 supporting the rectangular plate 29 of the flap seat 28 are also connected to the double walled portion of the body portion 1. The double walled portion of the body portion 1 is sufficiently strong for it to take up the forces that are induced in the container through the bar 13, the undercarriage 19, the flap seat 28 and the drawbar 32.

The profile of each body portion 1, 2 is designed so that seven or eight iron clubs, two wooden clubs, the drawbar 32 and the struts 20 of the undercarriage 19 can be accommodated in the container. The heads of the wooden clubs are the bulkiest heads of a set of golf clubs and it is desirable for a golf player to have at least two wooden clubs in the container for use on the links. When the container is in condition for transportation some of the clubs to be stored in the container are inserted into the container through the outer end of the body portion 2 and the remainder of the clubs to be stored in the container are inserted through the outer end of the body portion 2. The clubs that are inserted through the outer end of the body portion 2 are orientated so that the heads are nearer to the outer end of the body portion 2 than are the respective shafts and the clubs that are inserted through the outer end of the body portion 1 are orientated so that the heads are nearer to the outer end of the body portion 1 than are the respective shafts. The wooden clubs are orientated so that the heads are stacked and extend in the same direction as shown in FIG. 8. When it is desired to use the container on the links, the clubs having heads which are nearer to the outer end of the body portion 1 are retrieved through the outer end of the body portion 1. Then the container is converted into the condition for use as described above. The clubs that have been retrieved from the container are inserted into the container through the outer end of the body portion 1 with the shafts first.

The container may be designed to receive more than seven or eight iron clubs and two wooden clubs.

FIG. 9 illustrates a modification of the container which has been described above. The following description will be directed to only the those parts of the modified container which differ from the corresponding parts of the container described above or which are not present in the container which has been described above. Those parts of the modified container and the container describe above which are similar to each other have the same reference numerals.

The modified container comprises two pairs of body portions 1, 2 and 1', 2' which are coupled to one another by two pairs of U-shaped hooks 51 which are engaged detachably with two pairs of lugs. The hooks 51 are mounted on that side of the body portions 1 and 2 which is opposite to the flap seat 28. Each pair of hooks 51 and the respective pair of lugs are mounted respectively at the outer ends of the body portions 1 and 2 and the body portions 1' and 2'. The body portions 1 and 2 of the modified container differ from the body portions 1 and 2 of the modified container differ from the body portions 1 and 2 of the container described above only in that the body portions 1 and 2 have lugs for engagement with the hooks 51. The body portions 1' and 2' differ from the body portions 1 and 2 in that the body portions 1' and 2' have no provisions for connection with a drawbar, an undercarriage and a flap seat. FIG. 8 is a section through the modified container, showing one pair of hooks and the respective pair of lugs with which the hooks are engaged. The modified container is designed so that a full set of golf clubs can be stored therein. The two pairs of body portions are separated for transportation to and from the golf course.

A simplified version of the containers described above may be without the undercarriage, the flap seat and the drawbar. The simplified version may have a strap for carrying the container.

The first portion of the bar 13 may have further bores defined therein. The further bores are defined between the bore that is adjacent to the outer end of the first portion and the bore that is adjacent to the second portion of the bar 13. The further bores are arranged along the axis of the first portion of the bar 13 and are spaced from one another. The finger projecting from the plunger 15 may be inserted into a selected one of the further bores defined in the first lug so that the body portion 1 is located axially relative to the body portion 2. The axial setting of the body portion 1 is selected according to the type or length of the golf clubs that are stored in the container.

The cross-sectional area of a further modification of the container may be sufficiently large for the wheels of the undercarriage to be stored in the container.

The container is suited especially for golf players who travel a lot by car or by air because it stands up well to the stress and strain to which the container may be exposed during transportation. Moreover the container takes up very little space when it is in the condition for transportation.

What I claim is:

1. A telescopic container of golf clubs comprising at least one pair of telescopically related tubes one of which is disposed slidably within the other for telescopic movement of said one tube relative to the other between a first position in which the tubes are in a relatively protracted condition and a second position in which the tubes are in a relatively retracted condition, a carrying handle which extends substantially parallel to the axes of the tubes, means for interengaging said carrying handle and said other tube so as to retain said other tube in a selected one of said first and second positions, said interengaging means being in fixed relation to said other tube, and means for closing each tube at its outer end, said closure means being operable to open the outer end of each tube so that the golf clubs can be inserted and retrieved through the outer end of each tube whereby, when the container is in use, the tubes enclose the golf clubs over their full length so that each tube can be closed by the closure means at its outer end when the tubes are in the relatively protracted condition, and the golf clubs protrude from the outer end of one tube while the outer end of the other tube is closed by the closure means when the tubes are in the relatively retracted condition.

2. A container as claimed in claim 1, comprising two pairs of said telescopically related tubes arranged side-by-side and detachably coupled to one another.

3. A container as claimed in claim 1, each said tube having a cross-sectional area which is sufficiently large for said tube to accommodate the heads of at least two wooden clubs of a set of golf clubs in a manner in which one head is placed on top of the other club head and extends in the same direction as said other club head.

4. A container as claimed in claim 1, said one tube comprising a tubular sleeve and a tubular shaft having a first end portion disposed within the sleeve in axially and radially fixed relation to the sleeve and a second end portion slidably disposed within said other tube for telescopic movement of said one tube relative to the other tube, said tubular sleeve carrying a first annular member which is encompassingly disposed about the sleeve in fixed relation to the sleeve so as to surround the sleeve and said first end portion of the tubular shaft.

5. A container as claimed in claim 4, comprising an undercarriage, said undercarriage including ground engaging means and means for removably securing said ground engaging means to said first annular member.

6. A container as claimed in claim 5, comprising a flap seat and at least one strut for supporting the flap seat, the flap seat pivotally connected to said one strut at one of its ends, said one strut being pivotally connected at its other end to said one tube, the flap seat being pivotable relative to the tubes from a first condition in which the strut and the seat butt against one tube, into a second condition in which the strut and the seat form an angle and project from the tubes, and being pivotable from said second condition into said first condition.

7. A container as claimed in claim 6, comprising a drawbar detachably connected at one of its ends to at least one of said tubes.

8. A container as claimed in claim 1, comprising a first pair of abutment surfaces coacting with one another to stop further outward movement of said one tube relative to said other tube when the tubes are in the relatively protracted condition, one abutment surface of said first pair of abutment surfaces being carried by the handle and the other abutment surface of said first pair of abutment surfaces being carried by said interengaging means which are in fixed relation to said other tube.

9. A container as claimed in claim 8, comprising a second annular member carried by said other tube at the inner end thereof, said second annular member being encompassingly disposed about said other tube in fixed relation to said other tube.

10. A container as claimed in claim 9, comprising a second pair of abutment surfaces coacting with one another to stop further inward movement of said one tube relative to the other tube when the tubes are in the relatively retracted condition, one abutment surface of said second pair of abutment surfaces being defined on said first member which is fixed to said one tube and the other abutment surface of said second pair of abutment surfaces is defined on said second annular member which is fixed to said other tube.

11. A container as claimed in claim 9, said means for interengaging said handle and said other tube comprising a first lug which is fixed to said second annular member and at least one pair of recesses which are formed in said handle, said recesses being axially spaced apart by a distance which is equal to the length of the path of telescopic movement of said one tube relative to said other tube between said first and second positions, the first lug comprising a body having an aperture through which the handle projects and a cavity having a mouth defined in the periphery of the aperture and which houses a plunger having an end portion slidable through the mouth of the cavity and resilient means acting on the plunger to urge the plunger into contact with the handle, said recesses being formed on that side of the handle which faces the mouth of the cavity and being positioned relative to the mouth of the cavity so that, when the tubes are in a selected one of the relatively protracted and the relatively retracted conditions, a respective one of the recesses is aligned with the mouth of the cavity; the end portion of the plunger being urged into said one recess when that recess is in alignment with the mouth of the cavity so that said other tube is retained in the selected position by the engagement of the plunger and said one recess formed in the handle, and means for retracting the end portion of the plunger from each recess against the action of the resilient means to said one tube to again move relative to said other tube between said first and second positions.

12. A container as claimed in claim 11, comprising a second lug mounted on said other tube at a point thereon which is between said first lug and the outer end of said other tube, said second lug having an aperture and being spaced from said first lug by a distance sufficient for the handle to project into the aperture formed in said second lug when the tubes are in the relatively retracted condition.

13. A container as claimed in claim 8, said handle being fixed at one of its ends to said first annular member and carrying an abutment member which is mounted at the other end of said handle, said one abutment surface of said first pair of abutment surfaces being defined on said abutment member carried by the handle.

* * * * *